United States Patent [19]

Korner et al.

[11] Patent Number: 4,511,775

[45] Date of Patent: Apr. 16, 1985

[54] CIRCUIT BREAKER

[75] Inventors: Gerhard Korner, Schriesheim; Horst Plettner; Walter Viering, both of Hanau; Volker Rees, Darmstadt, all of Fed. Rep. of Germany

[73] Assignee: BBC Brown, Boveri & Company, Limited, Baden, Switzerland

[21] Appl. No.: 416,027

[22] Filed: Sep. 8, 1982

[30] Foreign Application Priority Data

Oct. 17, 1981 [DE] Fed. Rep. of Germany ..... 3141324

[51] Int. Cl.[3] ..... H01H 33/88

[52] U.S. Cl. ..... 200/148 A; 200/147 R

[58] Field of Search ..... 200/148 A, 147 R

[56] References Cited

U.S. PATENT DOCUMENTS

| | | | |
|---|---|---|---|
| 2,103,121 | 12/1937 | Slepian | 200/147 R |
| 3,549,842 | 12/1970 | Fischer | 200/148 A |
| 3,551,623 | 12/1970 | Colclaser, Jr. | 200/148 A |
| 3,551,624 | 12/1970 | Fischer | 200/148 A |
| 3,551,625 | 12/1970 | Fischer | 200/147 R |
| 3,551,626 | 12/1970 | Milianowicz | 200/148 A |

*Primary Examiner*—Robert S. Macon

*Attorney, Agent, or Firm*—Burns, Doane, Swecker & Mathis

[57] ABSTRACT

A circuit breaker, in particular a high-voltage circuit breaker employing $SF_6$ gas, possesses a fixed contact part, and a movable switching piece which is provided with a blast nozzle and can be actuated by a drive. During the process of tripping out, a compression space is rendered smaller to generate a flow of gas towards the blast nozzle and an arc produced during switching out by movement of a movable cylinder over a stationary piston head. In order to reduce the drive power, the compression space is surrounded by a coil for generating a magnetic field. The coil is capable of being switched into the current path in such a manner that, during the process of tripping out, current does not flow through the coil until disconnection has been effected at the main contact point. An auxiliary piston is located in the compression space. The auxiliary piston is capable of being driven by the magnetic field toward the contact point in order to render the compression space smaller.

19 Claims, 11 Drawing Figures

CIRCUIT BREAKER

BACKGROUND AND SUMMARY OF THE PRESENT INVENTION

The invention relates generally to a circuit breaker. More particularly the present invention relates to a high-voltage circuit breaker, insulated by $SF_6$ gas and including an arrangement for directing a blast of $SF_6$ gas on to the arc.

The circuit breaker further includes a fixed contact part and a movable switching piece which is provided with a blast nozzle and may be actuated by a drive. A compression space is rendered smaller during the process of tripping out, such that a flow of gas moves toward the blast nozzle and the arc produced. The compression space includes a movable piston in a cylinder which piston is pulled toward a stationary cylinder-bottom. Alternatively, a movable cylinder may be pulled over a stationary piston head, in order to generate the gas flow during the process of tripping out.

Circuit breakers of the above-mentioned type are known. In circuit breakers of this type, in order to direct a blast of gas onto the arc, the movable piston or the movable cylinder is, in each case, pulled towards the stationary part. In this way, the size of the compression space is reduced and the gas is compressed to a specified pressure which is sufficient to blast the gas on to the arc.

In these known blast-piston breakers, the energy for compressing the extinguishing gas in the compression space is provided solely by the drive of the circuit breaker. The dimensions of this drive must therefore be chosen so as to ensure that it is sufficiently powerful.

It is known, for example, in U.S. Pat. No. 3,331,935, to insert an auxiliary piston into the compression space in order to increase the compression in this space whenever the circuit breaker trips out. This auxiliary piston is driven by the force of a spring. The mechanism for actuating and driving the auxiliary piston is a latch-type mechanism and consequently is comparatively complicated. Accordingly, it is extremely difficult on account of this type of construction to reduce the overall size of the circuit-breaker drive.

Accordingly, an object of the present invention is to provide a circuit breaker of the type initially mentioned, which is of simpler construction, and which, as a consequence of this simpler construction, possesses a higher efficiency, accompanied by a smaller drive. This object and others are achieved according to the present invention.

Electrodynamic drives are known (compare Swiss Patent No. 594,977) but these drives are not used to actuate an auxiliary piston. These drives operate, in the event of a short-circuit, to additionally accelerate either the complete movable system of the circuit breaker, or at least the movable system of the extinguishing chamber. Also, these drives may be used to at least maintain the tripping-out speed at a value corresponding to the speed of the system when not under load.

The solution according to the present invention provides a circuit breaker in which the compression energy is produced in accordance with the following basic principle:

In a range corresponding to the rated currents and to small short-circuit currents, the compression energy is produced essentially by the circuit breaker drive. The circuit breaker drive is utilized up to current values corresponding to approximately 30% of the short-circuit current at which the circuit breaker is rated to trip out. Since, in this current range, the gas pressure in the compression volume of the breaker required for extinguishing the current is low, the breaker drive can be designed with a correspondingly low basic speed. Consequently, the drive can be dimensioned in a manner consistent with an advantageous low cost.

In a range corresponding to comparatively high short-circuit currents up to the short-circuit current at which the circuit breaker is rated to trip out, the pressure to which the extinguishing gas must be compressed in order to extinguish the arc is produced by the auxiliary piston. The auxiliary piston is driven by magnetic energy of the short-circuit current.

In a further aspect according to the present invention, a coil is provided as the means for generating the magnetic field. The coil concentrically surrounds the compression space. At the same time, a cylindrical inner shell is preferably provided inside a cylindrical outer shell which bounds the compression space externally. The inner shell is arranged with a clearance relative to the outer shell and insulated therefrom with the coil being located between the outer and inner cylindrical shells.

BRIEF DESCRIPTION OF THE DRAWINGS

The present invention, including further improvements, further developments, further advantages, and an explanation of these will be described in more detail with reference to the accompanying drawings, wherein a number of illustrative embodiments of the invention are respresented and wherein like members bear like reference numerals and wherein.

DETAILED DESCRIPTION OF THE PREFERRED EMBODIMENT

Figure 1:
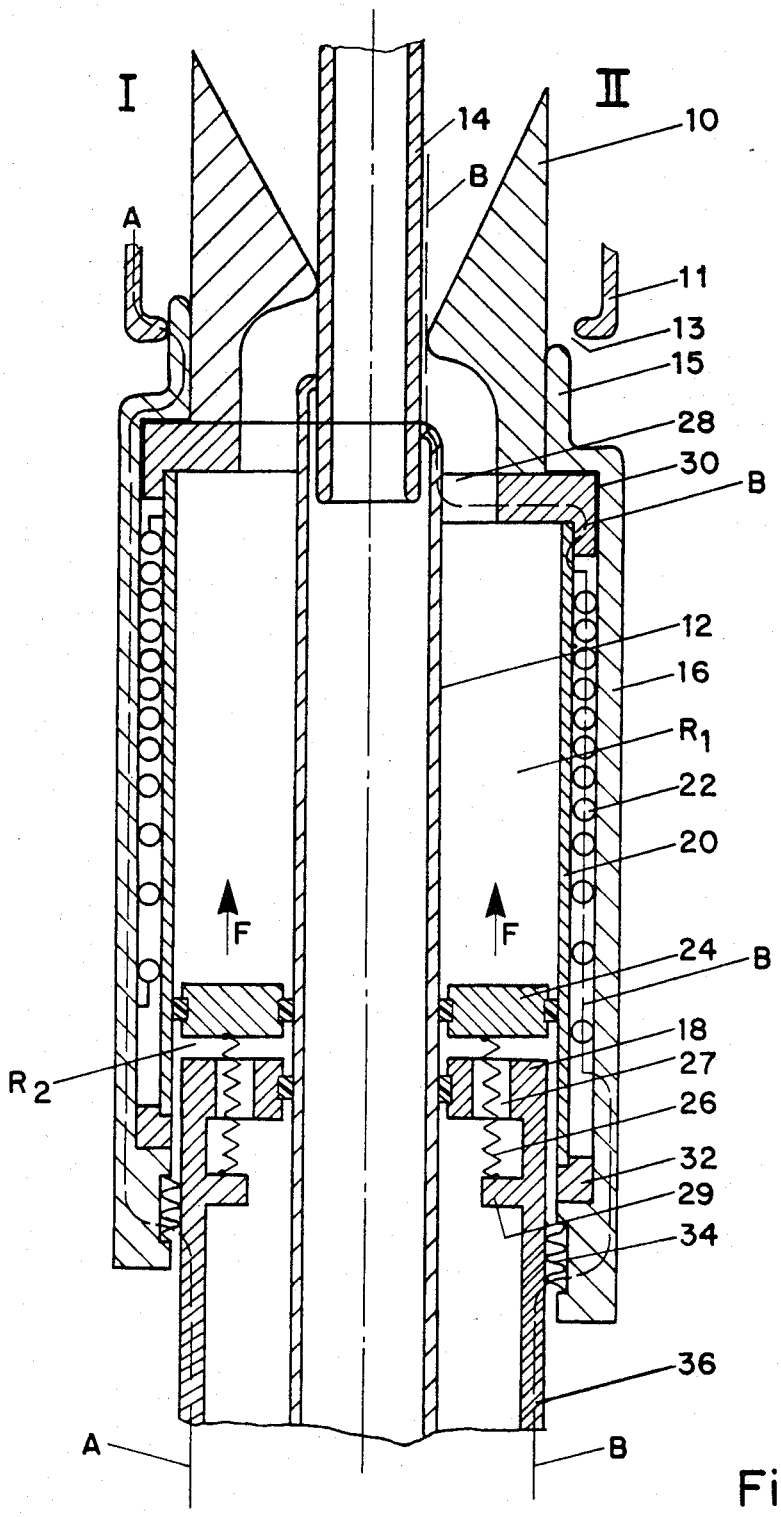
FIG. 1 is a longitudinal cross-sectional view through an extinguishing chamber of a circuit breaker, in a switched-in position (I), and in a position (II), in which the main contacts have separated.

With reference to FIG. 1, an extinguishing chamber of a circuit breaker is insulated by $SF_6$ gas and possesses a blast nozzle 10. The nozzle 10 is rigidly attached to a movable switching piece 12 which interacts with a fixed switching piece 14. A contact point between the pieces 12, 14 is surrounded by a main contact point 13. The main contact point 13 is formed by a contact basket with contact fingers 11, and by a cylindrical projection 15 on a main blast cylinder 16. This projection 15 interacts with the contact basket. In addition, the blast nozzle 10 is connected to the main blast cylinder 16 (also called "cylinder 16", for brevity), which, during the process of tripping out, is pulled over a stationary piston head 18.

A metallic tube 20 is located with a clearance relative to the main cylinder 16. The tube 20 surrounds a compression space $R_1$. A coil 22 is located between the metallic tube 20 and the main blast cylinder 16. One end of the coil 22 is connected to the metallic tube 20, in an electrically conductive manner, in the vicinity of the blast nozzle. The other end of the coil 22 is similarly connected to the main cylinder 16, which is made of a metallic material. In addition, the turns of the coil 22 are insulated with respect to one another, with respect to the cylinder 16, and with respect to the tube 20.

A movable annular piston 24 is made of a magnetic material and is located between the metallic tube 20 and the switching piece 12. The piston 24 is subjected to the force of springs 26. A piston head 18 is attached to a supporting tube 36 and possesses bores 27 through which the springs 26 extend. The other ends of the springs 26 are secured to projections 29, which are attached to the inner surface of the supporting tube 36.

The main cylinder 16 surrounds an annular web 28, made of an electrically conducting material. An insulating layer 30 is located between the main cylinder 16 and the web, or ring, 28, so that no electric current can flow from the cylinder 16 to the annular web 28. In a similar manner, the cylinder 16 is electrically insulated from the metallic tube 20 in the region of the stationary piston head 18 by an insulating ring 32. The only electrically conducting connection between the main cylinder 16 and the stationary piston head 18 is provided by sliding-contact elements 34.

In a switched-in position (I), the path over which the nominal current passes is represented by the broken line A—A. The current flows from the main contacts 11, through the cylinder 16 and the contacts 34, to the piston head 18 and to the supporting tube 36 which is attached to the piston head 18. In the switched-in state of the circuit breaker, the insulating layer 30, which is fitted between the cylinder 16 and the annular web 28, prevents current from flowing through the coil 22. In this way, the coil winding does not have to be designed for the continuous current for which the breaker is rated. The position (II) in FIG. 1 shows the position of the breaker when the main contact point 13 has just opened.

During the process of tripping out, the breaker drive (not illustrated in more detail) pulls the blast cylinder 16 (tube 16) over the stationary piston head 18. As a result of this movement, the compression space $R_1$ between the blast nozzle 10, the tube 20 and the stationary piston head 18 is rendered smaller and the gas in the space $R_1$ is thereby compressed. After disconnection at the main contact point 13, the current commutates onto the fixed contact piece 14, and flows, according to the broken line B—B, from the contact piece 14 to the movable contact piece 12 and, through the webs 28, to the metallic tube 20, to the coil 22 and, via the cylinder 16 and the sliding contacts 34, to the supporting tube 36. As a result, the coil 22 generates a magnetic field which moves the annular piston 24 which is made of a magnetic material in the direction of arrow F. Consequently, the compression space $R_1$ is rendered smaller for the purpose of directing a blast of gas on to the arc both by the movement of the cylinder 16 and additionally by the movement of the annular ring on piston 24.

The magnetic coil 22 is preferably attached to the inner tube 20 with a variable pitch-spacing between the turns (as indicated in FIG. 1 by the different distances between the individual turns). In this way, the magnetic field varies spatially in the coil-axis direction such that a magnetic force is exerted on the magnetic annular piston 24 in every position relative to the magnetic coil in the direction of the arrow F (FIG. 1).

The magnetic tube 20 which serves as a supporting tube for the magnetic coil 22 is slotted longitudinally. The slot is filled with insulating material in order to close off the compression space $R_1$ in a gas-tight manner. The slot effectively prevents induced eddy-currents from flowing in the tube 20 so that the magnetic field generated by the magnetic coil 22 acts with virtually no attenuation in the space $R_1$ in which the magnetic annular piston 24 moves.

Figure 10:
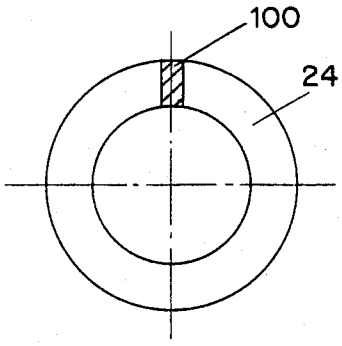
FIG. 10 is a plan view of the annular piston according to FIG. 8 or FIG. 9.

With reference to FIG. 10, the magnetic annular piston 24 is preferably provided with a slot, which is filled with insulating material 100, for example, casting resin. With this arrangement, eddy-currents are almost completely suppressed in the annular piston 24 so that no undesired force can act in opposition to the direction of arrow F (FIG. 1) due to the Thompson effect.

Figure 2:
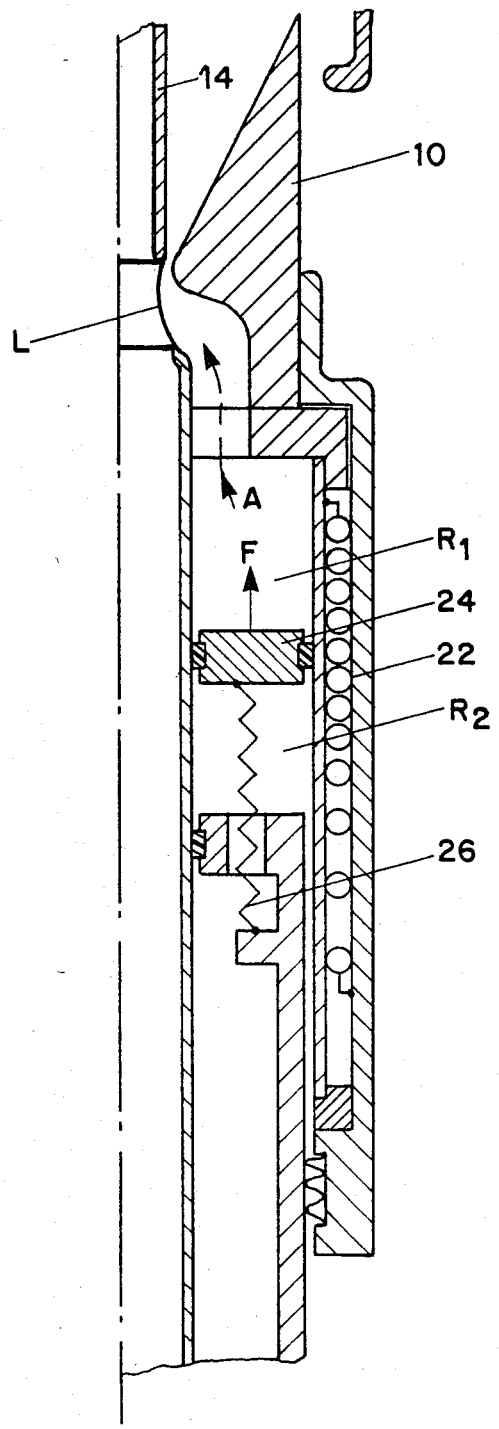
FIG. 2 is a partial view of the breaker according to FIG. 1, in the extinguishing position.

With reference to FIG. 2 to further illustrate the sequence of movements, a blast of gas is directed on to the arc L in the extinguishing position of the breaker. Due to the action of the force exerted by the magnetic coil 22, through which current is flowing from the short-circuit, the annular piston 24 is moved in the direction of the arrow F, so that the gas in the compression space $R_1$ is strongly compressed and a powerful flow A of extinguishing medium acts on the arc. After the arc has been extinguished, i.e., after the short-circuit current has been interrupted, the magnetic force becomes zero such that the force exerted by the return springs 26 pulls the annular piston 24 back again into its starting position. The spring 26 or, rather the springs 26, since, for symmetry reasons, at least two springs should be provided, serve as return springs and extend through the bores 27 in the stationary piston head 18. These bores 27 simultaneously also serve to depressurize the space $R_2$ between the annular piston 24 and the stationary piston head 18. Accordingly, the springs 26 do not have to act against the pressure of the gas which is present in the space $R_2$.

Numerous advantages of the arrangement described above are realized. For example, the compression of the extinguishing gas in the compression space is effected independently of the power of the circuit breaker drive. The pressure to which the gas is compressed is matched to the level of the short-circuit current which is to be switched off. The short-circuit current itself does not give rise to any retardation of the breaker drive. The breaker drive, which moves the movable contact system in opposition to direction of the arrow F, can be designed for a low basic speed. On account of the low drive energy required for such a low basic speed, the drive can be produced at an advantageously low cost. Only the mass of the magnetic annular piston 24 needs to be accelerated by the magnetic field of the short-circuit current. This movement occurs without any reaction effects on the breaker drive, so that the extinguishing gas is subjected to rapid compression.

Figure 3:
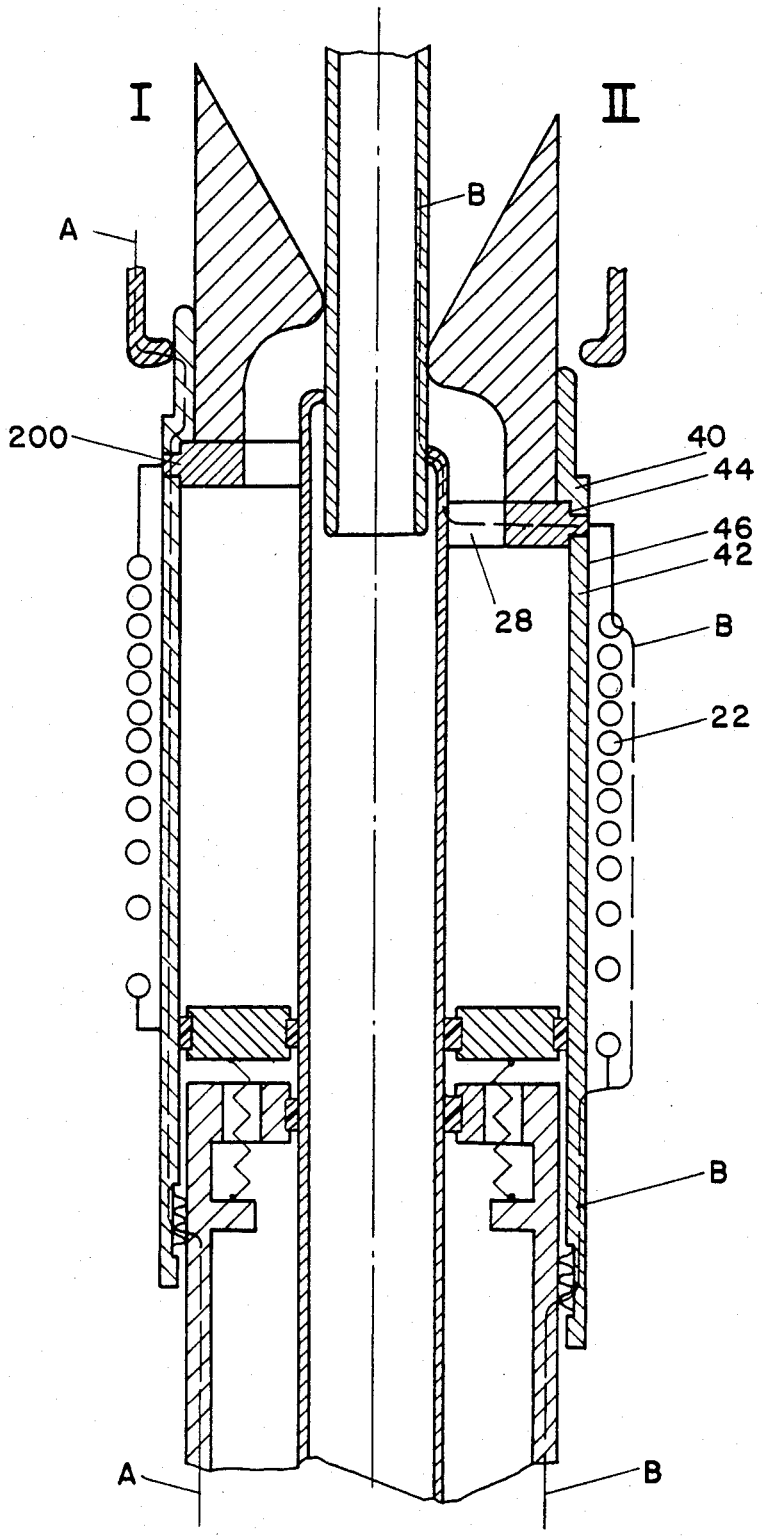
FIG. 3 is a schematic view of a second embodiment of the circuit breaker according to the present invention similar to that shown in FIG. 1.

Another embodiment of the breaker according to FIGS. 1 and 2 is illustrated in FIG. 3. In contrast to FIGS. 1 and 2, the inner tube 20 in FIG. 1 is, in this case, dispensed with. The metallic tube 16 serves both as a blast cylinder and as a support for the magnetic coil 22. In this embodiment, the ring or annular web 28 is used to retain both a cylindrical projection 40, which serves as a contact ring, and the metallic tube 24, which serves as a blast cylinder.

Figure 11:
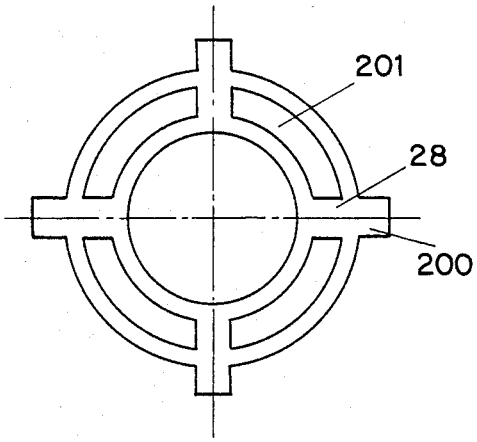
FIG. 11 is a plan view of the annular web which attaches a nozzle of the circuit breaker to a movable switching piece.

In order to be used in this embodiment of the breaker, the ring or annular web 28 (FIG. 11) is provided with lugs 200, which are distributed uniformly over the periphery. The ring 28 also includes openings 201 for the gas flow. These openings are designed with an annular shape and, in the embodiment according to FIG. 11, the openings are interrupted in the region of the lugs 200.

The unit which is formed by the contact ring 40 and the metallic tube 42 is provided with openings in the region of the web which openings are distributed over the periphery and correspond to the lugs 200 of the web. The lugs 200 are engaged in openings in the contact ring 40 and the metallic tube 42. At the same time, the lugs 200 and the web 28 are electrically separated from the contact ring 40, and from the metal tube 42, by insulating layers 46 and 44. The two parts 40 and 42 are, of course, connected together in an electrically conducting manner. One end of the coil 20 is connected to the web 28 (electrically insulated from the parts 40 and 42) and the other end of the coil is connected to the metal ring 42.

The arrangement described above, comprising the web 28, the contact ring 40, and the metallic tube 42, ensures that no current flows through the magnetic coil when the circuit breaker is in the switched-in state or position (FIG. 3, position I and current flow A—A in FIG. 1).

The mode of operation of the embodiment of FIG. 3 is substantially the same as that in the case of the breaker according to FIG. 1.

Figure 4:
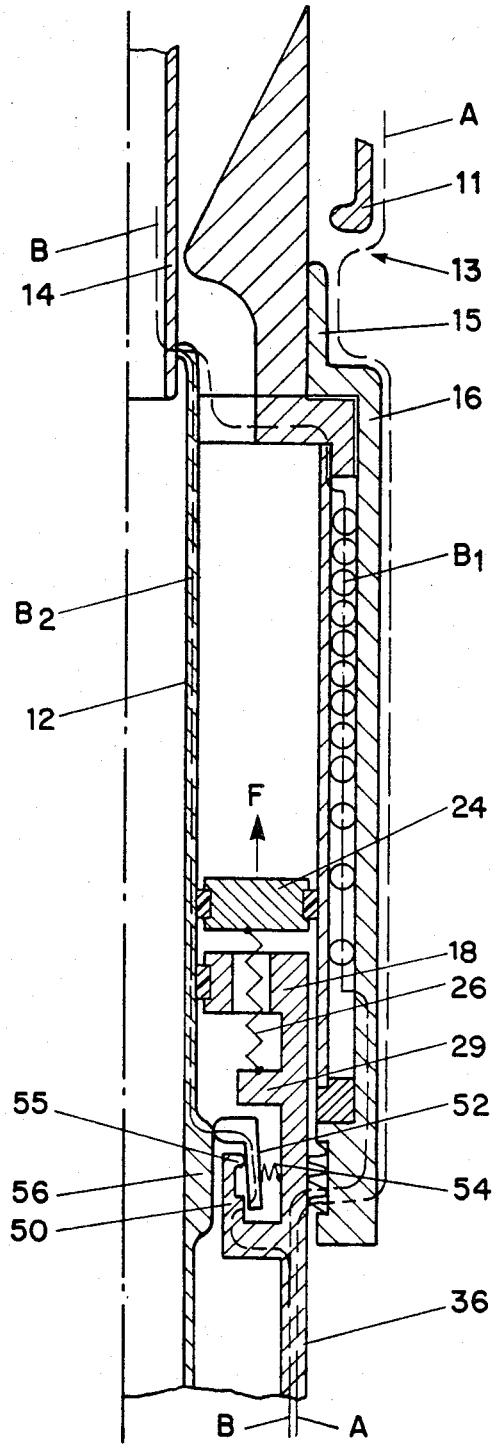
FIG. 4 is a schematic view of a third embodiment of a circuit breaker according to the present invention in the disconnected or separated position, similar to the position according to position (II) of FIG. 1 or FIG. 3.

With reference to FIG. 4, and in a further embodiment of a breaker according to the present invention, the structural design of the breaker is identical to the design according to FIGS. 1 to 3. However, a suitable auxiliary or commutating contact-device is provided in the region beneath the stationary piston head 18. An L-shaped projecting extension 50 is located on the supporting tube 36. This extension 50 points toward the contact point 13 and receives L-shaped contact fingers 52. The fingers 52 are inwardly loaded, under the pressure of one or more springs 54 arranged at right angles to the movable contact tube 12. A circumferentially thickened portion 56 is located on the contact piece 12. This portion 56 interacts with the contact fingers 52.

In the switched-in state, the contact finger, or contact fingers, 52, rest on the outside surface of the thickened portion 56. In the switched-in state, the main current path again runs in accordance with the broken line A—A. Afterwards, when the main contact point 13 has opened (as shown in FIG. 4), the current commutates along the current paths B—$B_1$—B and B—$B_2$B. In other words, the current then flows, firstly, from the fixed contact piece 14, via the movable contact piece 12 and the contact fingers 52, to the supporting tube 36, and also, secondly, to the supporting tube 36, via the coil 22. Since, however, the resistance through the current path $B_2$ is smaller than the resistance through the current path $B_1$, the greater part of the current initially flows via the path $B_2$ and the contact fingers 52. In other words, following the opening of the main contact point 13, the greater part of the short-circuit current commutates along the current path B—$B_2$—B, which has a low inductance, thus preventing heavy commutating burn-off from occurring at the main contact point 13. Consequently, degradation of the capability of the point at which the contact fingers 11 and the cylindrical contact-projection 15 touch each other to carry, in the switched-in state, the nominal current for which the circuit breaker is rated is prevented.

As the tripping-out movement of the breaker proceeds further, the contact fingers 52 leave the outer surface of the thickened portion 56, while the fixed contact piece 14 and the movable contact piece 12 are still touching each other. The current path B—$B_2$—B is interrupted at the contact fingers, and the whole of the short-circuit current commutates onto the magnetic coil 22, in accordance with the current path B—$B_1$—B. Due to the presence of the noses 55 which serve as a stop, the contact fingers 52 are securely held in the position represented in FIG. 4 which prevents contact with the switching piece 12 except along the thickened portion 56. At the same time, the commutating function is assumed solely by the commutating contact-system, which comprises the contact fingers 52 and the upper end of the thickened portion. The magnetic coil 22 is excited, and the action of the magnetic force drives the annular piston 24 in the direction of arrow F in order to compress the extinguishing gas.

Figure 5:
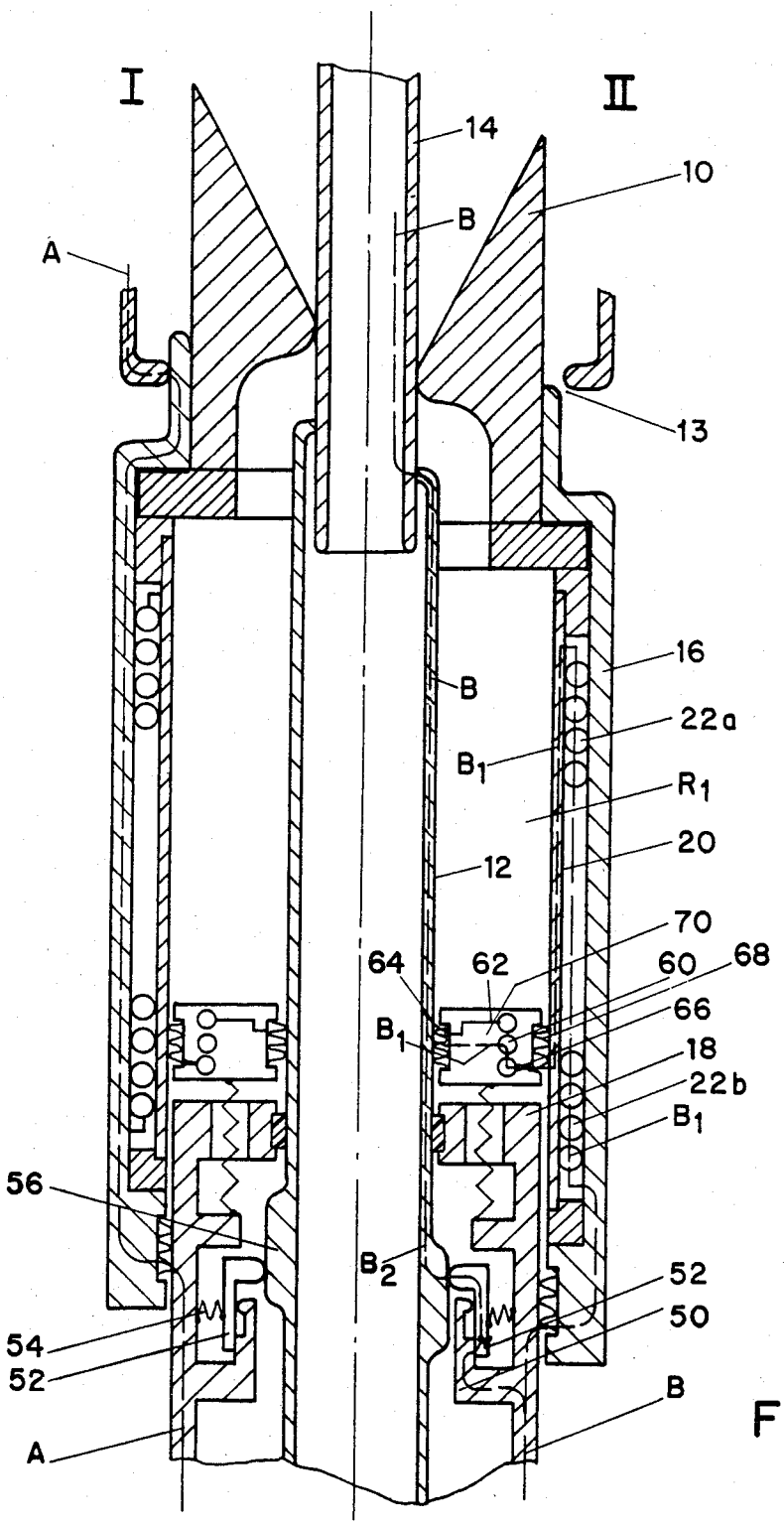
FIG. 5 is a schematic view of a further embodiment of a circuit breaker according to the present invention in a view similar to that shown in FIG. 1 or FIG. 3.
Figure 6:
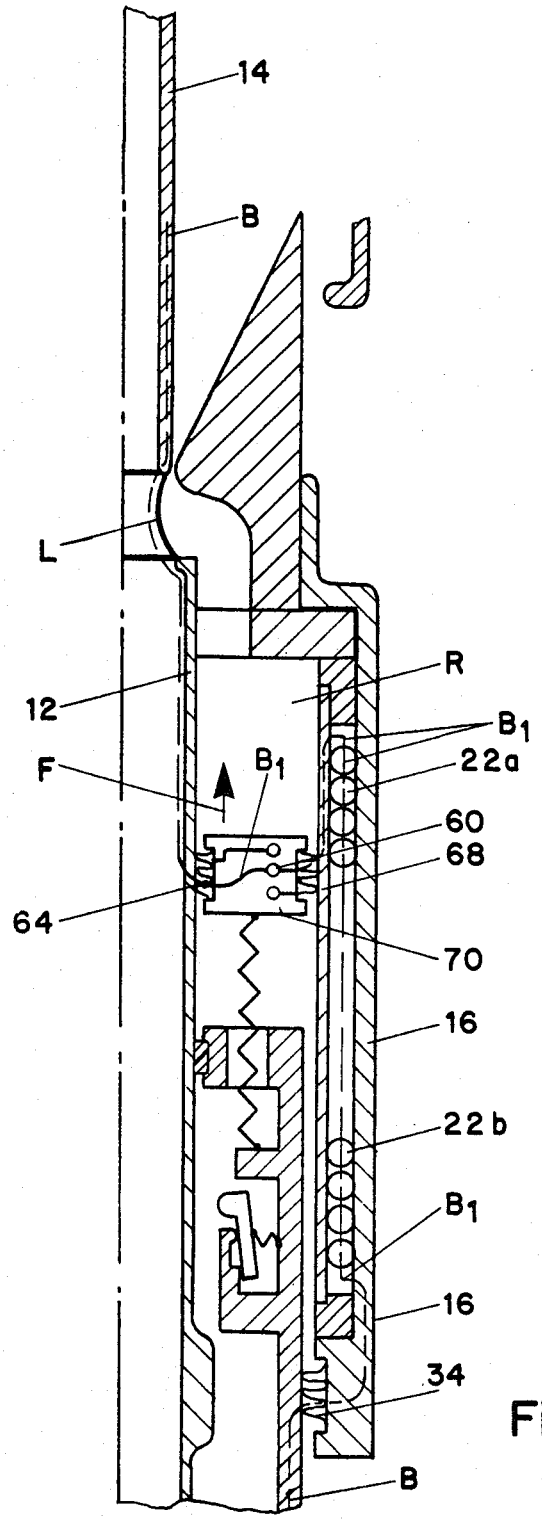
FIG. 6 is a partial schematic view of the circuit breaker according to FIG. 5 in the extinguishing position.
Figure 7:
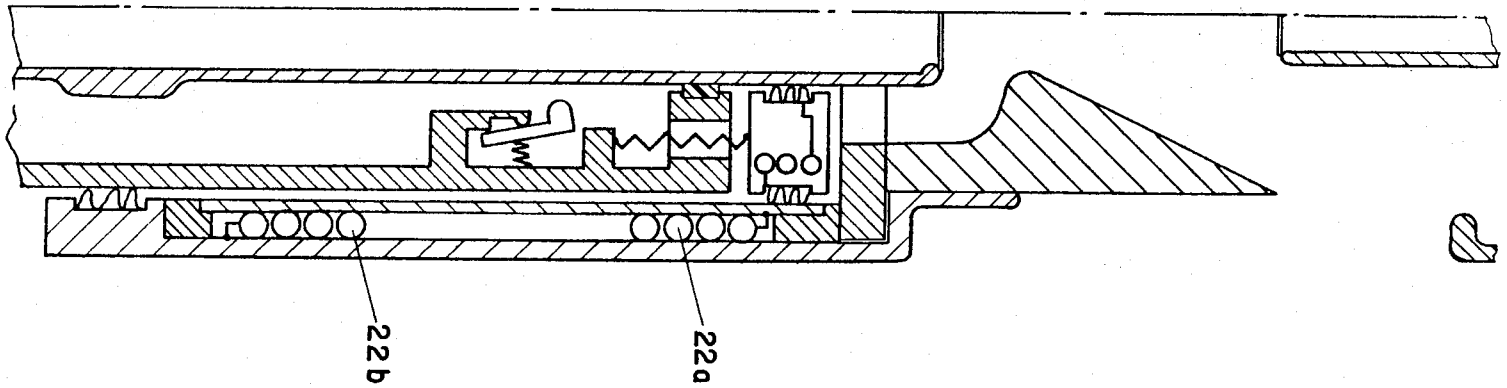
FIG. 7 is a partial schematic view of the circuit breaker according to FIGS. 5 and 6 in a tripped-out position.

A further embodiment is illustrated in FIGS. 5 to 7. In FIG. 5, position I shows the switched-in position, while position II in FIG. 5 shows the position in which the main contact point 13 is just opening. FIG. 6 is a view of the breaker in a position in which the action of the electro-magnetic force is driving the compression piston in the direction of arrow F, while FIG. 7 is a view of the tripped-out position.

This embodiment of the circuit breaker is formed from a combination of the breaker according to FIGS. 1 to 4. In this breaker, analogous to the arrangement of FIG. 4, the supporting tube 36 possesses the L-shaped extension 50, the nose 55, and the contact fingers 52 which are pressed against the thickened portion 56 on the movable switching piece 12. In contrast to the embodiments according to FIGS. 1 to 4, the movable magnetic annular piston 24 is replaced in the compression space $R_1$ by a movable piston which comprises a second coil 60 embedded in insulating material 70. One end 62 of the coil 60 is connected, in an electrically conducting manner, to the movable switching piece 12 via sliding-contact pieces 64. The other end 66 of the coil 60 is connected, in an electrically conducting manner, to the tube 20 via further sliding contact pieces 68.

In further contrast to the embodiments according to FIGS. 1 to 4, the magnetic coil 22 is arranged between the inner tube 20 and the outer tube 16 such that a first portion of the coil windings **22*a* is located in the vicinity of the nozzle region 10, while a second portion 22b, which is wound in the opposite direction, is located in the region of the stationary piston 18. The two portions 22***a* and 22*b* of the coil are electrically connected to each other, and are electrically insulated with respect to the tubes 20 and 16.

The current is now routed as follows. In the switched-in state, the current flows to the supporting tube 36, in accordance with the broken line A—A. At the instant when the contact point 13 opens, the current flows (in accordance with the broken line $B—B_2—B$) from the fixed contact piece 14 to the supporting tube 36, through the movable switching piece 12 and the contact fingers 52. A comparatively small partial current $B_1$ flows from the movable switching piece 12, via the sliding-contact pieces 64, the end 62, and the coil 60, to the end 66, and, through the sliding-contact pieces 68, into the metallic tube, and thence, via the coil 22, the tube 16, and the sliding-contact piece 34, to the supporting tube 36 ($B—B_1—B$).

It is apparent that the resistance via the coil 60 and the coil 22 is initially considerably greater than the resistance of the current path $B—B_2—B$, so that the greater proportion of the current flows in accordance with the broken line $B—B_2—B$.

In the further course of the opening movement, the contact fingers 52 leave the cylindrical thickened portion 56, such that the current path $B—B_2—B$ is interrupted. Consequently, the whole of the short-circuit current flows along the current path $B—B_1—B$.

The coils are wound such that the coil portion 22*b* is wound in the opposite direction to the movable coil 60, and the coil portion 22*a* is wound in the same direction as the coil 60. As a result, a repulsive force acts between the coil portion 22*b* and the coil 60, and an attractive force acts between the coil portion 22*a* and the coil 60. In this way, the insulating material piston 70, with the embedded coil 60, is moved under the action of the electromagnetic force in the direction of the arrow F, and compresses the extinguishing gas in the space $R_1$.

With reference to FIG. 6, and with the circuit breaker in the extinguishing position, the movable contact fingers 52 have left the thickened portion 56. Accordingly, the whole of the current flows, in accordance with the broken line $B—B_1—B$, from the contact piece 14, via the arc L, the movable switching piece 12, the sliding contact 64, the coil 60, and the sliding contact 68, to the metallic tube 20. Thereafter, the current flows, via the coil 22, to the main cylinder 16, and thence, via the sliding-contact piece 34, to the supporting tube 36.

Figure 8:
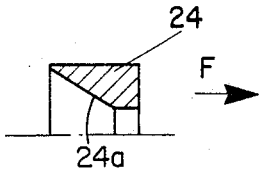
FIG. 8 is a cross-sectional view through an annular piston according to the present invention as employed in the circuit breaker according to FIG. 1.

The annular piston 24 is made of a magnetic material and may be produced with a rectangular annular cross-section (FIGS. 1 to 4). It is possible, in order to increase the magnetic force-effect in the direction of arrow F, to design the cross-section of the annular piston in the shape of a triangle. The tip of the triangle is preferably located on the outer periphery of the piston on the side opposite to the piston surface. In this arrangement, the inner surface of the piston, i.e., the internal diameter of the piston, widens linearly at 24*a* (FIG. 8).

Figure 9:
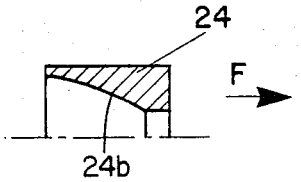
FIG. 9 is a cross-sectional view of a second embodiment of the annular piston.

There is also the possibility of designing the piston in other configurations. With reference to FIG. 9, the piston possesses an internal cross-section which widens parabolically.

The invention has been represented and explained by reference to a number of illustrative embodiments. It is obvious that there exist numerous modifications which all remain within the scope of the protection of the concept of the invention. Thus, a further possibility of driving the auxiliary piston by the magnetic energy of the short-circuit current involves arranging the movable coil as a short-circuit coil, with one or several short-circuit turns, embedded in the insulating material. In this arrangement, the short-circuit current does not flow directly through the movable coil, but rather a circulating current is induced in the coil. This current is directed such that the current flows in the direction opposite to the short-circuit current in the outer magnetic coil 22. In this way, the coil 22 exerts a repulsive effect on the piston with the embedded short-circuit coil (Thompson effect). The configuration of the magnetic coil 22 required for this purpose is obtained by designing the part coil 22*a* (see FIGS. 5 to 7) such that the short-circuit current does not flow through the part coil 22*a*. Alternatively, turns of the part coil 22*a* may be omitted such that the short-circuit current flows solely through the windings of the part coil 22*b*. It is obvious that the movable, short-circuited winding can also be formed by a single turn, which is formed, as an annular piston, from a non-magnetic material.

Any other suitable insulating gas can, of course, be used in the circuit breakers according to the invention, instead of $SF_6$ gas.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in claims be embraced thereby.

What is claimed is:

1. A circuit breaker, in particular a high-voltage circuit breaker, insulated by $SF_6$ gas, comprising, a fixed contact part, a movable switching piece, the movable switching piece being provided with a blast nozzle and adapted to be actuated by a drive, a $SF_6$ gas containing compression space being decreased in volume during the process of tripping out such that a flow of the $SF_6$ gas is directed by the blast nozzle toward the arc being produced during the tripping out, the compression space being bounded by a piston-cylinder arrangement for generating the gas flow during the process of tripping out, the piston-cylinder arrangement being such that at least one of a movable piston and a movable cylinder is pulled toward at least one of a stationary cylinder bottom and a stationary piston head, respectively, the compression space being concentrically surrounded by a coil for generating a magnetic field, said coil being adapted to be switched into the current path such that during the process of tripping out a short-circuit current does not flow through the coil until disconnection has been effected at a main contact point of the breaker, a cylindrical inner shell is provided inside a cylindrical outer shell which bounds the compression space externally, the inner shell being arranged with a clearance relative to the outer shell and being insulated therefrom, the coil being located between the outer and inner cylindrical shells, an auxiliary piston being movably arranged in the compression space, the auxiliary piston being adapted to be driven by the magnetic field toward the contact point to render the compression space still smaller.

2. The circuit breaker as claimed in claim 1, wherein the auxiliary piston is made of a magnetic material.

3. The circuit breaker as claimed in claim 2, wherein the auxiliary piston has a cross-section having the shape of a rectangular annulus.

4. The circuit breaker as claimed in claim 2, wherein the auxiliary piston is annular and has an inner surface which is shaped such that the cross-section formed by this inner surface widens.

5. The circuit breaker as claimed in claim 4, wherein the interior cross-section widens linearly.

6. The circuit breaker as claimed in claim 4, wherein the interior cross-section widens parabolically.

7. The circuit breaker according to claim 1, wherein the auxiliary piston has a slot arranged along the movement axis, the slot being filled with insulating material.

8. The circuit breaker as claimed in claim 1, wherein the magnetic coil is wound with a variable spacing between each individual turn and the next adjacent turn.

9. The circuit breaker as claimed in claim 1, wherein the auxiliary piston is formed from insulating material, an additional coil being embedded in the insulating material, the short-circuit current flowing through said additional coil.

10. The circuit breaker as claimed in claim 9, wherein the magnetic coil is divided into two part coils, the part coils being interconnected in an electrically conductive manner and being wound in opposite directions.

11. The circuit breaker as claimed in claim 9, wherein the additional coil is wound such that the additional coil experiences a force due to the magnetic field of the magnetic coil in the direction of the blast nozzle of the circuit breaker.

12. The circuit breaker as claimed in claim 1, wherein the auxiliary piston is driven toward the contact point against the force of a spring.

13. The circuit breaker as claimed in claim 1, wherein commutation of a short-circuit current to the magnetic coil is effected from the main contact point.

14. The circuit breaker as claimed in claim 1, further comprising a separate contact system for commutating of the short-circuit current to the magnetic coil.

15. The circuit breaker as claimed in claim 1, wherein the inner cylindrical tube which is surrounded by the magnetic coil is provided with a slot running longitudinally of the tube, the slot being filled with insulating material so as to be gas-tight.

16. The circuit breaker as claimed in claim 9, wherein the additional coil is a short-circuited coil through which the short-circuit current does not flow directly.

17. The circuit breaker as claimed in claim 16, wherein the additional, short-circuited coil comprises a plurality of turns.

18. The circuit breaker as claimed in claim 16, wherein the additional, short-circuited coil comprises a single turn made of a non-magnetic material, the turn being shaped such that it forms the auxiliary piston.

19. The circuit breaker as claimed in claim 16, wherein the magnetic coil through which the short-circuit current flows is arranged such that a repulsive force is exerted on the movable short-circuit coil, whereby the gas space is rendered smaller.

* * * * *